United States Patent [19]

Malta

[11] 4,121,534

[45] Oct. 24, 1978

[54] ADJUSTMENT MEANS FOR HANDBELLS

[76] Inventor: Jacob H. Malta, 207 Decatur St., Doylestown, Pa. 18901

[21] Appl. No.: 798,165

[22] Filed: May 18, 1977

[51] Int. Cl.[2] ..... G10K 1/071

[52] U.S. Cl. ..... 116/171

[58] Field of Search ..... 116/171, 150, 155, 167

[56] References Cited

U.S. PATENT DOCUMENTS

| | | | |
|---|---|---|---|
| 229,564 | 7/1880 | Van Duzen | 116/167 |
| 1,848,020 | 3/1932 | Merrill | 116/150 |
| 3,207,124 | 9/1965 | Malta | 116/171 |
| 3,941,082 | 3/1976 | Malta | 116/171 |

*Primary Examiner*—Daniel M. Yasich

*Attorney, Agent, or Firm*—John T. Marvin

[57] ABSTRACT

A handbell including an improved clapper assembly utilizing an adjustable clapper bearing whereby wear that may cause poor fidelity of tone may be eliminated through periodic adjustment of said bearing without disassembly of the bell or other disturbance of the "factory" assembly thereof.

6 Claims, 7 Drawing Figures

ADJUSTMENT MEANS FOR HANDBELLS

This invention relates to handbells and is particularly concerned with adjustable bearings for handbell clappers whereby compensation for wear thereof may be quickly and easily obtained without the use of new bearings and the like.

In my U.S. Pat. No. 3,941,082 I disclose and claim a handbell that includes several novel and very useful features that permit a change in tonal qualities through manipulation of the clapper member together with positive indexing between the bell handle and the direction of swing of the clapper assembly within the bell. The instant disclosure is directed to a major improvement in the design of the clapper bearing as used in said handbells. This bearing permits the clapper member to swing in one plane only and, after long and substantial service, gains a degree of end play that may cause deviations in tonal quality due to shifting of the clapper with respect to the area of strike thereof on the bell per se. Similar problems occur in handbells using other designs, such as are shown and disclosed in my prior U.S. Pat. No. 3,253,574, for example.

The present invention is directed to a handbell having an adjustable clapper bearing which is self-centering and easily adjustable to take up end play whereby compensation for wear may be obtained for yielding continued fidelity of tone and constancy of action throughout the life of the handbell. It is therefor an object of this invention to provide a handbell including a clapper member with an adjustable, self-centering clapper bearing that may be manually manipulated periodically to compensate for wear at said bearing surfaces.

In carrying out the foregoing object, it is a further object of the invention to provide a handbell with a centrally located axle block from which is depended a clapper member swingable in one plane only through a bifurcated terminus which embraces opposite ends of said axle block and is attached thereto by means of an axle pin that is adjustable axially thereof for compensating for deviations in dimensions between the said axle block and the bifurcated terminus of said clapper member.

In carrying out the above object, it is a still further object to provide said combination with adjustment means in the form of a screw or screws that may be adjusted periodically for changing the end play and/or wobble between said clapper member and said axle block.

To improve the self-centering action of said adjustment means, it is another object of the invention to use a screw or screws that include tapered portions to provide self-centering end play adjustment through the tightening of said screw or screws.

Further objects and advantages will be apparent, reference being had to the accompanying drawings and specification wherein preferred forms of my invention are clearly shown and described.

In the drawings:

FIG. 1 shows a handbell similar to that shown and described in my U.S. Pat. No. 3,941,082.

Handbells, as mentioned in my prior U.S. Pat. No. 3,941,082 are becoming increasingly popular and this increase in acceptance and use has required greater sophistication of design to eliminate wear factors and to increase the life of said bells while maintaining fidelity of tonal qualities. A full chorus of handbells costs a substantial sum and, when purchased, is expected to give many years of trouble-free service. During this service, wear does occur at the moving parts of said handbells, mainly at the axle block bearing which carries the swingable clapper. After long and heavy use, this bearing wears to permit a degree of end play and/or wobble between the supporting block and the clapper. When this occurs, fidelity of the tonal qualities of the bell is affected adversely and, more importantly, such wear becomes progressively greater as time progresses. Until the present invention, the only solution to this problem was to tear down the bell and replace the supporting axle block or the pin that connected the axle block to the clapper, or both. This service required an expert mechanic and caused the handbell to be out of use while repairs and adjustments were being made.

Figure 1:
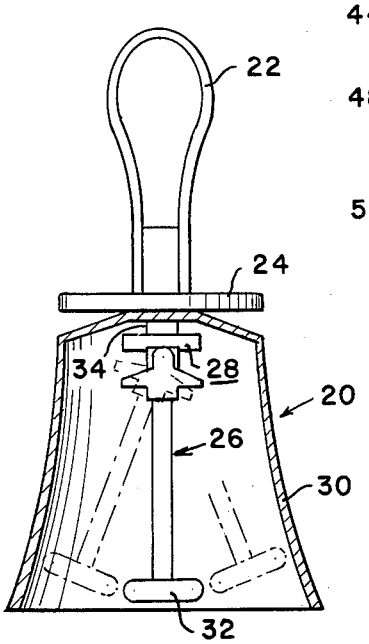

The present invention obviates the disruption in use of the bell and makes on-the-spot adjustments, to eliminate end-play and/or wobble between the clapper and its axle block, possible through the simple expedient of adjusting one or more adjustment screws to eliminate said end play. This adjustment may be made easily by generally unskilled persons and may be accomplished without disassembly of the bell. Referring specifically to FIG. 1 of the drawings, a handbell 20 is shown, partly in section, which has a handle 22, a hand-shielding disc 24, and a clapper member 26 located centrally and suspended from a stationary axle block 28 that is suitably and non-rotatably associated with the handle 22 through the bell housing 30. The clapper member 26 includes a clapper 32 depended at its free end which when the handbell is in use, will swing from said axle block 28 into contact with alternate sides of said bell 30. All of this structure is substantially similar to that described and claimed in my foregoing U.S. Pat. No. 3,941,082.

Figure 2:
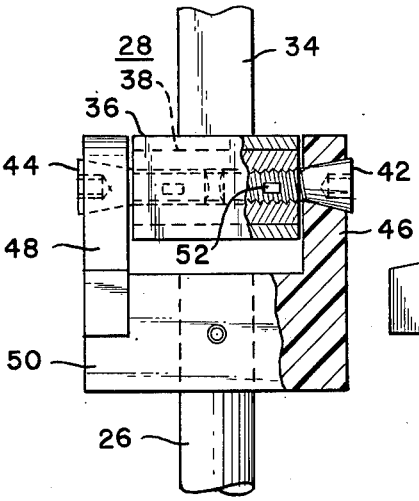
FIG. 2 is an enlarged and partially cut-away view of one form of axle block bearing suitable for use with the clapper member shown in FIG. 1 wherein the structure has been rotated 90° from the position shown in FIG. 1.

The improvements described and claimed herein are directed specifically to details of the hinged connection between the clapper member 26 and the axle block 28 wherein adjustability is provided so that end play and/or wobble between the said clapper member and the axle block, as caused by wear, is eliminated through a novel adjustment means. Referring specifically to FIG. 2, one form of the improved structure is disclosed wherein the section through the axle block 28 and the clapper member 26 is taken at ninety degrees to the position of said parts as shown in FIG. 1. Here, the portion 34 of the axle block 28 connects through the bell housing 30 with the handle 22. The axle block 28 also includes an integral cross member 36 positioned at ninety degrees to the vertical portion 34 that connects with the handle 22. The cross member 36 is broached longitudinally thereof to provide a square hole therethrough as designated at 38. Slidably fitted within said hole 38 is a square plug member 40 which has a longitudinal dimension equal to the cross member 36. The plug 40 is drilled axially thereof and threaded so as to receive a pair of opposed screws 42 and 44 that pass through opposed upstanding portions 46 and 48 of the bifurcated end 50 of the clapper member 26. When the screws 42 and 44 are in place, the clapper member 26 is swingable with respect to the axle block 28. The important design feature here concerns the screws 42 and 44 which each have tapered head portions that mate with similarly tapered apertures through the upstanding portions 46 and 48 of the bifurcated end 50 of the clapper member 26 and which form bearing surfaces for the tapered head portions of the screws 42 and 44. Each of the screws 42 and 44 include means for tightening them in place such as hexagonal depressions in their heads which will accommodate a key for adjustment thereof. Each of the screws 42 and 44 may also be provided with a cross-positioned insert (leather or plastic, etc.) shown at 52 which will act as a friction lock against accidental loosening of the screws, as is well-known in the art. Also the threads may be coated with a commercial thread locking compound such as "Nylock" VC-3 or similar widely known commercially available materials that will prevent unpremeditated loosening thereof. In the present embodiment, the adjustment of one screw only, such as 42, will adjust the end play between both ends of the clapper shaft and the axle block 28. In this manner any wear may be overcome.

It is to be understood that the bifurcated upper portion 50 of the clapper member 26 may be fabricated from any suitable material. In my prior patent, referred to heretofore, the bifurcated end portion 50 was made of metal that could be screwed or otherwise attached to the clapper member 26. In the present disclosure, the bifurcated end portion 50 is shown as being fabricated from a plastic material such as a polyamide resin (Nylon), an acetal resin (Delrin) or any other suitable nonmetallic material. The resin may also be filled with glass or other suitable fibers to lend strength thereto. The use of a plastic molding for part 50 reduces overall costs while in no way lessening the usefulness of the assembly. Of course, in very large bells, metal parts are generally preferred both for strength and because of excessive molding costs. In all instances, the bifurcated end portion 50 is permanently attached against accidental dislodgement from the clapper member 26 by means of a pin, or other suitable means.

In practice, adjustments are made at the time of manufacture with respect to the proper clearances. As time progresses and the bearing surfaces wear so as to cause some end play, the screws 42 or 44, as the case may be, may be adjusted to compensate for such wear whereby the clearance between parts is returned to the desired figure similar to that used at the time of manufacture. The adjustment is easy to accomplish with all parts in place and the result will re-establish the clapper assembly to its "as manufactured condition".

Figure 3:
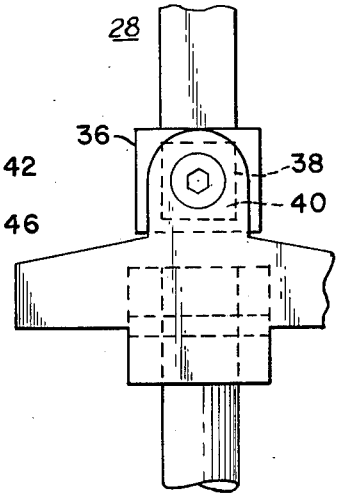
FIG. 3 is a side view of the structure disclosed in FIG. 2.
Figure 4:
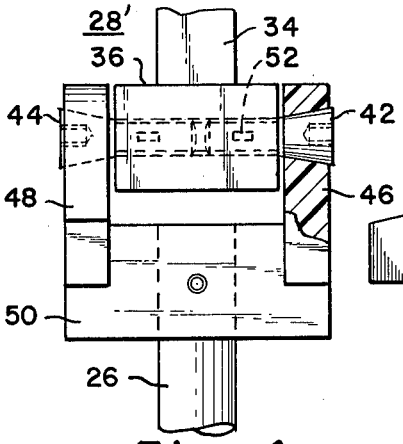
FIG. 4 is a view similar to that shown in FIG. 2 but using another design of axle block bearing which will accomplish the same results.
Figure 5:
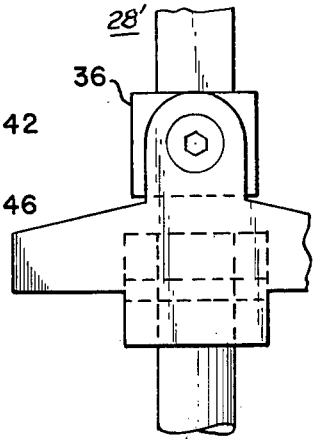
FIG. 5 is a side view of the structure shown in FIG. 4.

FIGS. 4 and 5 and FIGS. 6 and 7 disclose variations of the adjustment means disclosed in FIGS. 2 and 3. Each embodiment eliminates the square broaching of the axle block cross member 36. In FIGS. 4 and 5, the screws 42 and 44 must both be adjusted to overcome end-play. In this case the screws 42 and 44 are similar to those disclosed heretofore and each is shown with a friction producing insert 52 as previously discussed.

Figure 6:
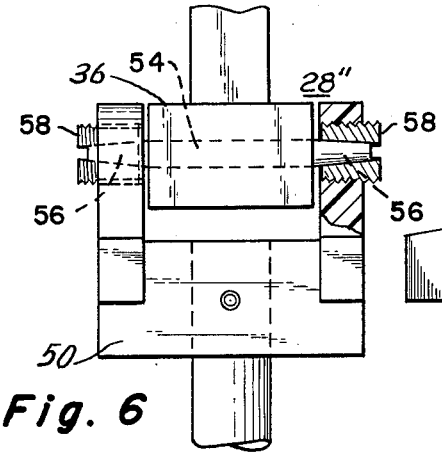
FIG. 6 is still another form of axle block bearing that may be used to accomplish results similar to those obtained with the structure shown in FIG. 2 and, FIG. 7 is a side view of the structure disclosed in FIG. 6.
Figure 7:
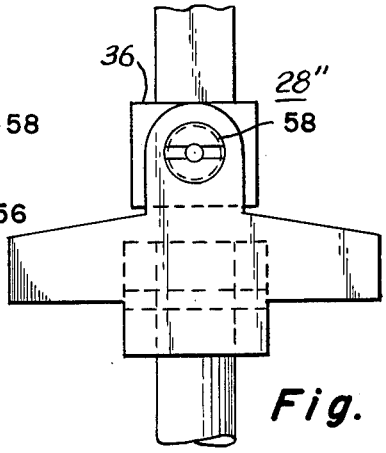

FIGS. 6 and 7 disclose still another variation in design. Here a pin 54 is provided with identical and opposed tapered end portions. These end portions are carried in opposed receiving bearings 58 threadably carried in opposed bifurcated portions 46 and 48 of the clapper member 26. The bearings 58 each have a tapered bore that corresponds to the taper on the end portions 56 of the pin 54. Thus, when it is desired to adjust the assembly to take up end play and the like, the bearings 58 are each screwed inwardly a sufficient amount to overcome the objectionable end play. Again, friction producing devices or materials may be provided to prevent any accidental displacement of the adjustment. In all three embodiments, the centering of the clapper member is maintained. In the first embodiment by design and in the second and third by means of careful adjustment to maintain proper centering of the clapper member. In all instances, a very slight adjustment will take care of normal wear and return the entire assembly to substantially original clearances and conditions.

The invention disclosed herein provides means for making adjustments in the field, obviating expensive returns, delays and the like while bringing the bell in question back to its original clearances with a minimum of effort and expense. While the forms of embodiment of the present invention constitute preferred forms, it is to be understood that other forms may be adopted, all coming within the scope of the claims which follow.

I claim:

1. A handbell comprising in combination, a bell housing, a handle connected with said bell housing; a clapper carried centrally within said bell housing and swingable in one plane only into contact with opposed portions of said housing; (a journal) bearing means for said clapper carried by said bell housing; and adjustment means operatively coacting with said (journal) bearing means for varying end play between said clapper and said (journal) bearing means and for simultaneously maintaining said clapper in centered relation to said bell housng, said adjustment means being carried by said clapper and being manually adjustable while said clapper is in its assembled position within said bell housing for adjusting the end play between said bell housing, bearing means and (said) clapper.

2. The handbell claimed in claim 1 wherein said adjustment means comprises a self-centering device whereby said clapper is always maintained in centered relation with respect to said bell housing and its journal.

3. A handbell comprising in combination: a bell housing, a handle connected with said bell housing; a clapper carried within said bell housing and swingable in one plane only into contact therewith; (a journal) bearing means for said clapper carried by said bell housing, said (journal) bearing means comprising a stationary axle block adapted to be embraced by a bifurcated end on said clapper, and adjustable, self-centering attachment means connecting said axle block and said clapper for permitting swinging movement of said clapper relative to said axle block, said adjustable means being capable of taking up end play caused by wear between said clapper and said axle block upon manual manipulation thereof.

4. The handbell as claimed in claim 3 wherein the adjustable, self-centering means includes spaced tapered surfaces for centering the clapper with respect to said axle block.

5. The handbell claimed in claim 4 wherein the spaced tapered surfaces may be adjusted simultaneously.

6. The handbell claimed in claim 4 wherein the spaced tapered surfaces are adjustable individually.

* * * * *